US005233838A

United States Patent [19]

Howard

[11] Patent Number: 5,233,838

[45] Date of Patent: Aug. 10, 1993

[54] AUXILIARY COLUMN CRYOGENIC RECTIFICATION SYSTEM

[75] Inventor: Henry E. Howard, Grand Island, N.Y.

[73] Assignee: Praxair Technology, Inc., Danbury, Conn.

[21] Appl. No.: 890,838

[22] Filed: Jun. 1, 1992

[51] Int. Cl.[5] ..... F25J 3/02

[52] U.S. Cl. ..... 62/25; 62/43

[58] Field of Search ..... 62/24, 25, 43

[56] References Cited

U.S. PATENT DOCUMENTS

| | | | |
|---|---|---|---|
| 3,079,759 | 3/1963 | Schilling | 62/25 |
| 4,224,045 | 9/1980 | Olszewski et al. | 62/30 |
| 4,254,629 | 3/1981 | Olszewski | 62/13 |
| 4,303,428 | 12/1981 | Vandenbussche | 62/13 |
| 4,453,957 | 6/1984 | Pahade et al. | 62/25 |
| 4,604,116 | 8/1986 | Erickson | 62/13 |
| 4,822,395 | 4/1989 | Cheung | 62/22 |
| 4,936,099 | 6/1990 | Woodward et al. | 62/24 |
| 5,069,699 | 12/1991 | Agrawal | 62/24 |
| 5,077,978 | 1/1992 | Agrawal et al. | 62/22 |
| 5,080,703 | 1/1992 | Rathbone | 62/38 |
| 5,098,456 | 3/1992 | Dray et al. | 62/24 |
| 5,098,457 | 3/1992 | Cheung et al. | 62/24 |
| 5,108,476 | 4/1992 | Dray et al. | 62/24 |

*Primary Examiner*—Ronald C. Capossela
*Attorney, Agent, or Firm*—Stanley Ktorides

[57] ABSTRACT

A cryogenic rectification system having an auxiliary column and a double column plant wherein liquid oxygen from the double column plant is vaporized prior to recovery against auxiliary column top vapor producing additional reflux for the double column plant thereby sustaining oxygen recovery under elevated pressure conditions.

14 Claims, 3 Drawing Sheets

AUXILIARY COLUMN CRYOGENIC RECTIFICATION SYSTEM

TECHNICAL FIELD

This invention relates generally to the cryogenic rectification of feed air, and is particularly advantageous for use in elevated pressure operations.

BACKGROUND ART

Elevated pressure product, such as oxygen and nitrogen, produced by the cryogenic rectification of feed air is increasing in demand due to such applications as coal gasification combined-cycle power plants.

One way of producing elevated pressure product from a cryogenic rectification plant is to compress the products produced by the plant to the requisite pressure. However, this approach is costly both because of the initial capital costs and because of the high operating and maintenance costs for the compressors.

Another way of producing elevated pressure product from a cryogenic rectification plant is to operate the plant columns at a higher pressure. However, this puts a separation burden and thus a recovery burden on the system because cryogenic rectification depends on the relative volatilities of the components and these relative volatilities are reduced with increasing pressure.

One way for sustaining the separation of feed air at elevated rectification pressures is feeding the largest possible portion of the feed air into the higher pressure column of a double column air separation plant. This achieves the maximum amount of high purity nitrogen reflux that the conventional double column arrangement can attain. However, at sufficient pressure levels this method will not be sufficient to avert significant reductions in oxygen recovery.

Another way for sustaining the separation of feed air at elevated rectification pressures is the utilization of heat pump compression loops. In such methods one or more low pressure streams are recycled through additional compression equipment and the compressed flow is returned to the column system to further drive the separation. Such systems are complicated to operate efficiently and are also costly depending upon the specific compression equipment employed.

Accordingly, it is an object of this invention to provide a cryogenic rectification system which can operate at elevated pressure with improved recovery over that attainable with conventional high pressure systems.

SUMMARY OF THE INVENTION

The above and other objects which will become apparent to one skilled in the art upon a reading of this disclosure are attained by the present invention one aspect of which is:

A method for the cryogenic rectification of feed air comprising:

(A) providing feed air into a double column air separation plant having a higher pressure column and a lower pressure column and separating the feed air by cryogenic rectification in the double column plant into nitrogen vapor and oxygen liquid;

(B) providing secondary feed air into an auxiliary column operating at a pressure less than that of said higher pressure column and separating the secondary feed air by cryogenic rectification in the auxiliary column into nitrogen-enriched vapor and oxygen-enriched liquid;

(C) passing oxygen-enriched liquid from the auxiliary column into the double column air separation plant, withdrawing oxygen liquid from the double column air separation plant, and reducing the pressure of the withdrawn oxygen liquid;

(D) condensing nitrogen-enriched vapor by indirect heat exchange with reduced pressure oxygen liquid, and passing at least a portion of the resulting condensed nitrogen-enriched fluid into the double column air separation plant; and (E) recovering oxygen fluid resulting from the indirect heat exchange with nitrogen-enriched vapor as product oxygen.

Another aspect of the invention is:

Apparatus for the cryogenic rectification of feed air comprising:

(A) a double column air separation plant having a higher pressure column and a lower pressure column, and means for providing feed air into the double column air separation plant;

(B) an auxiliary column having a top condenser and means for providing feed air into the auxiliary column;

(C) means for passing fluid from the lower portion of the auxiliary column into the double column air separation plant, and means for passing fluid from the upper portion of the auxiliary column into the top condenser;

(D) means for passing fluid from the double column air separation plant to pressure reducing means and from the pressure reducing means into the top condenser;

(E) means for passing fluid from the top condenser into the double column air separation plant and means for recovering fluid from the top condenser.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150° K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the term "compressor" means a device for increasing the pressure of a gas.

As used herein, the term "expander" means a device used for extracting work out of a compressed gas by decreasing its pressure.

As used herein, the terms "upper portion" and "lower portion" mean those sections of a column respectively above and below the midpoint of a column.

As used herein, the term "reflux" means the downflowing liquid phase in a column produced from condensing vapor.

As used herein, the term "top condenser" means a heat exchange device which generates downflow liquid from column top vapor. A top condenser may be physically within or outside a column shell.

DETAILED DESCRIPTION

The invention comprises the use of an auxiliary column upstream of a double column air separation plant enabling the double column system to operate at higher pressures while consuming reduced amounts of power and attaining improved product recovery compared with conventional high pressure systems. The power reduction is achieved because the feed air flow to the auxiliary column is of a lower pressure than that of the higher pressure column resulting in a net power decrease for the system. The auxiliary column also sustains the liquid nitrogen available to the lower pressure column of the double column plant thus facilitating high pressure operation without recovery degradation. The vaporization of oxygen at a pressure lower than the pressure of the lower pressure column facilitates the operation of the column system at high pressures. The use of the reduced pressure auxiliary column results in sustained oxygen recovery as the pressure of the double column arrangement is increased. It creates this result by supplying a larger flow of high purity nitrogen reflux to the upper column. Additionally, this increased flow is achieved by an accompanying decrease in air compression power required by the overall configuration.

Figure 1:
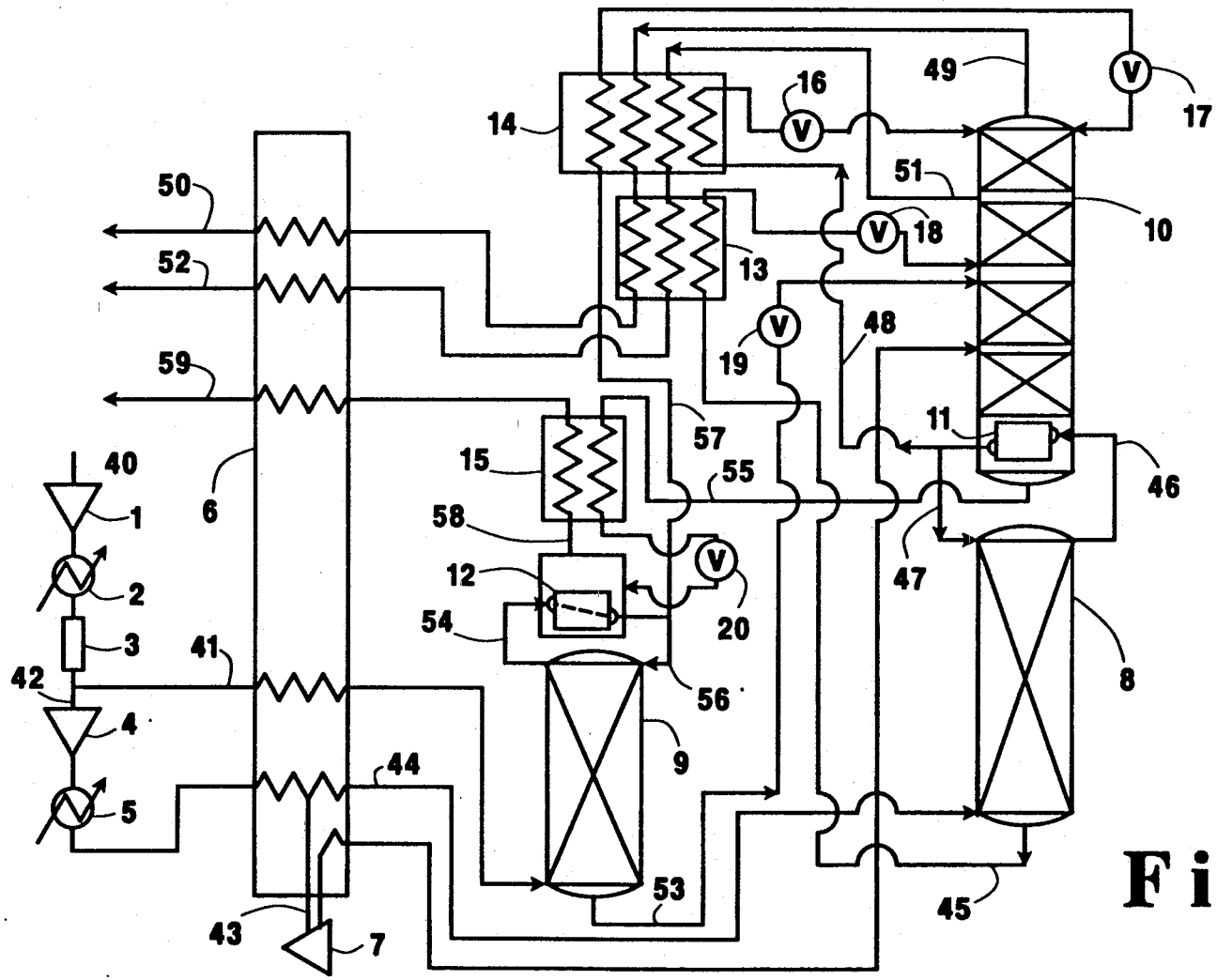
FIG. 1 is a schematic flow diagram of one preferred embodiment of the cryogenic rectification system of this invention wherein main feed air is passed into both the higher pressure and lower pressure columns of the double column air separation plant.

The invention will be described in detail with reference to the Drawings. Referring now to FIG. 1, feed air 40 is compressed in compressor 1, subsequently cooled in heat exchanger 2 and cleaned of high boiling contaminants and/or non-condensibles in adsorptive means 3. A portion 41 comprising from about 15 to 45 percent of stream 40 is cooled to a temperature close to its dewpoint by passage through main heat exchanger 6 and this secondary feed air stream 41 is provided into auxiliary column 9. The remaining portion 42 of the feed air is further compressed in compressor 4, cooled in heat exchanger 5, and further cooled to a temperature close to its dewpoint in main heat exchanger 6. At an intermediate point of main heat exchanger 6 a fraction 43 of the feed air is removed and expanded through expander 7 to a reduced pressure corresponding to approximately the pressure of lower pressure column 10. The expanded stream is then reintroduced into main heat exchanger 6, cooled to a temperature close to its dewpoint and then fed into an intermediate location of lower pressure column 10.

The double column air separation plant comprises higher pressure column 8, operating at a pressure generally within the range of from 75 to 250 pounds per square inch absolute (psia), and lower pressure column 10, operating at a pressure less than that of higher pressure column 8 and generally within the range of from 17 to 85 psia. Feed air 44 is passed from main heat exchanger 6 into higher pressure column 8 of the double column air separation plant.

Within higher pressure column 8 the feed air is separated by cryogenic rectification into a fraction richer in nitrogen than the feed air and a fraction richer in oxygen than the feed air. The oxygen-richer fraction is withdrawn from column 8 as stream 45, subcooled by passage through heat exchanger 13, reduced in pressure through valve 18 and passed into column 10. The nitrogen-richer fraction is withdrawn from column 8 as stream 46 and condensed in bottom reboiler 11 by indirect heat exchange with boiling column 10 bottoms. A part 47 of the resulting nitrogen-richer liquid is returned to column 8 as reflux and another part 48 is subcooled by passage through heat exchanger 14, passed through valve 16 and then into column 10 for reflux.

Within column 10 the various feeds are separated by cryogenic rectification into nitrogen vapor, having a nitrogen concentration of from 98 to 99.99 percent or more, and into an oxygen liquid having an oxygen concentration of from 75 to 99.9 percent. Nitrogen vapor is withdrawn from the upper portion of column 10 in stream 49, warmed by passage through heat exchangers 14, 13 and 6 and recovered as nitrogen product 50. Recovering as product means removal from the system and includes actual recovery as product as well as release to the atmosphere. There may be instances when one or more of the products produced by the invention is not immediately required and releasing this product to the atmosphere is less costly than storage. A nitrogen-containing stream 51 is also withdrawn from the upper portion of column 10 for product purity control purposes, warmed by passage through heat exchangers 14, 13 and 6 and removed from the system as stream 52.

Auxiliary column 9 is operating at a pressure less than that of higher pressure column 8 and generally within the range of from 75 to 250 psia. Generally, column 9 will operate at a pressure greater than that of column 10. Within auxiliary column 9 the secondary feed air is separated by cryogenic rectification into nitrogen-enriched vapor and oxygen-enriched liquid. Oxygen-enriched liquid is withdrawn from the lower portion of auxiliary column 9 in stream 53, passed through valve 19 and into lower pressure column 10 of the double column air separation plant as an additional feed stream for separation into nitrogen vapor and oxygen liquid. If desired, stream 53 may be combined with stream 45 prior to passage into column 10. Nitrogen-enriched vapor is passed in stream 54 into auxiliary column top condenser 12. If desired, some nitrogen-enriched vapor may be recovered as product nitrogen.

Oxygen liquid is withdrawn from the lower portion of lower pressure column 10 of the double column air separation plant in stream 55, subcooled by passage through heat exchanger 15, and is reduced in pressure by passage through a pressure reducing device such as valve 20. The reduced pressure oxygen liquid is then passed into top condenser 12 wherein it is vaporized by indirect heat exchange with condensing nitrogen-enriched vapor. Preferably, a portion 56 of the resulting condensed nitrogen-enriched liquid is passed into auxiliary column 9 as reflux. If a portion of the resulting condensed nitrogen-enriched liquid is not used to reflux the auxiliary column, some liquid nitrogen, such as from the double column system will be supplied to the auxiliary column. At least a portion 57 of the resulting condensed nitrogen-enriched liquid is subcooled by passage through heat exchanger 14, reduced in pressure through valve 17 and passed into the upper portion of column 10 of the double column air separation plant as additional reflux at a point above the point where stream 53 is passed into column 10. If desired, stream 57 may be combined with stream 48 prior to passage into column 10.

Oxygen vapor resulting from the heat exchange in top condenser 12 with condensing nitrogen-enriched vapor is withdrawn from top condenser 12 as stream 58, warmed by passage through heat exchangers 15 and 6 and recovered as product oxygen 59 generally at a pressure within the range of from 17 to 85 psia.

In order to demonstrate the advantages of the invention over conventional elevated pressure cryogenic air separation processes, a computer simulation of the embodiment of the invention illustrated in FIG. 1 was carried out wherein the pressure at the base of the higher pressure column was about 202 psia and the pressure at the base of the auxiliary column was about 75.5 psia. The liquid oxygen withdrawn from the base of the lower pressure column had an oxygen concentration of 90 percent. The oxygen recovery was 97.9 percent. For comparative purposes, a conventional double column air separation system operated at the same pressure and with the same refrigeration configuration and oxygen purity had an oxygen recovery of only 93.1 percent.

Figure 2:
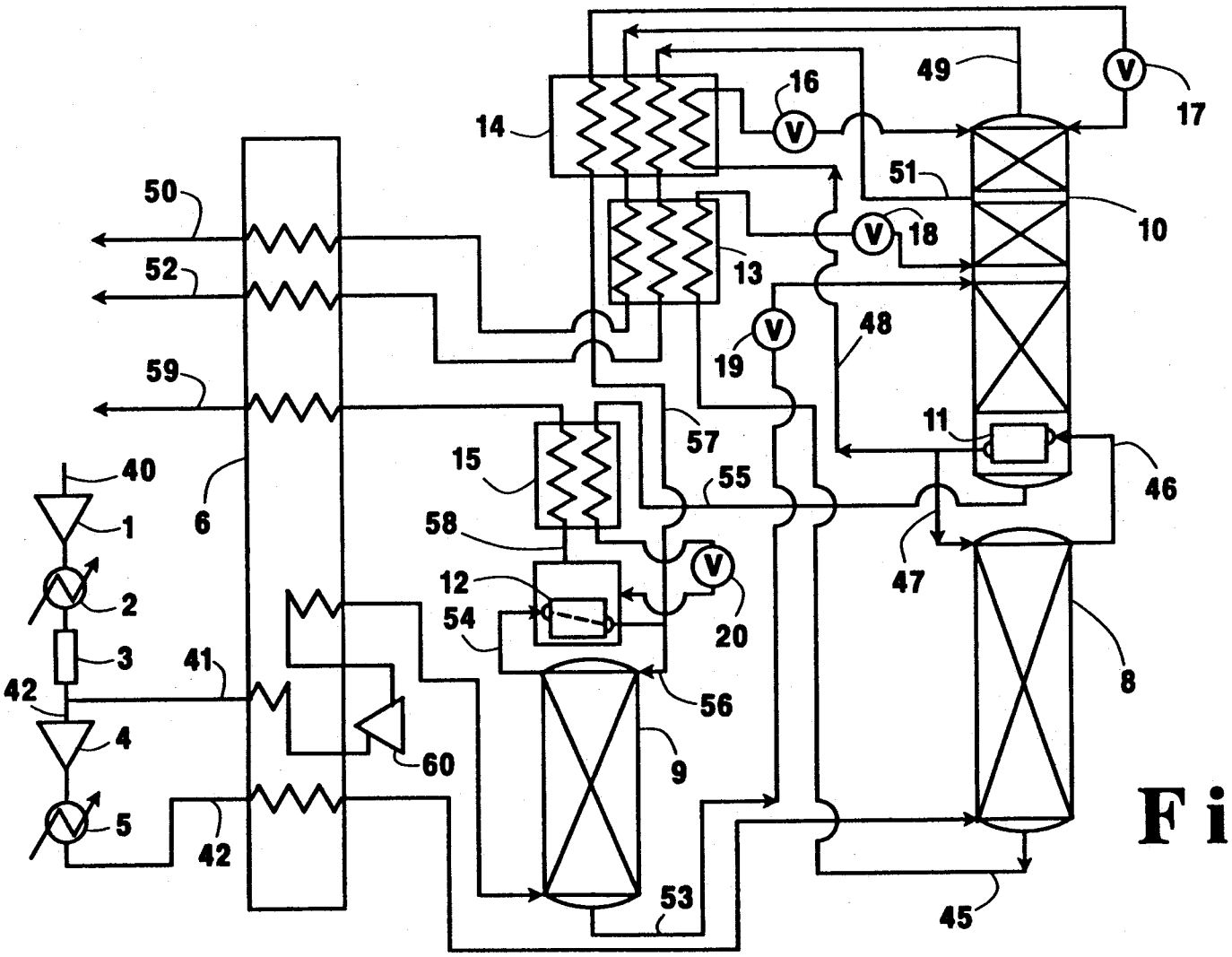
FIG. 2 is a schematic flow diagram of another preferred embodiment of the cryogenic rectification system of this invention wherein the secondary feed air is expanded prior to being passed into the auxiliary column.

FIG. 2 illustrates another embodiment of the invention. The numerals in FIG. 2 correspond to those of FIG. 1 for the common elements and these common elements will not be described again in detail. In the FIG. 2 embodiment, the entire feed air stream 42 is passed through heat exchanger 6 and into higher pressure column 8. At an intermediate point secondary feed air stream 41 is removed and turboexpanded through tuboexpander 60 to a pressure corresponding to approximately the operating pressure of auxiliary column 9. The expanded stream is subsequently reintroduced into main heat exchanger 6 and further cooled to a temperature close to its dewpoint and then fed into auxiliary column 9.

Figure 3:
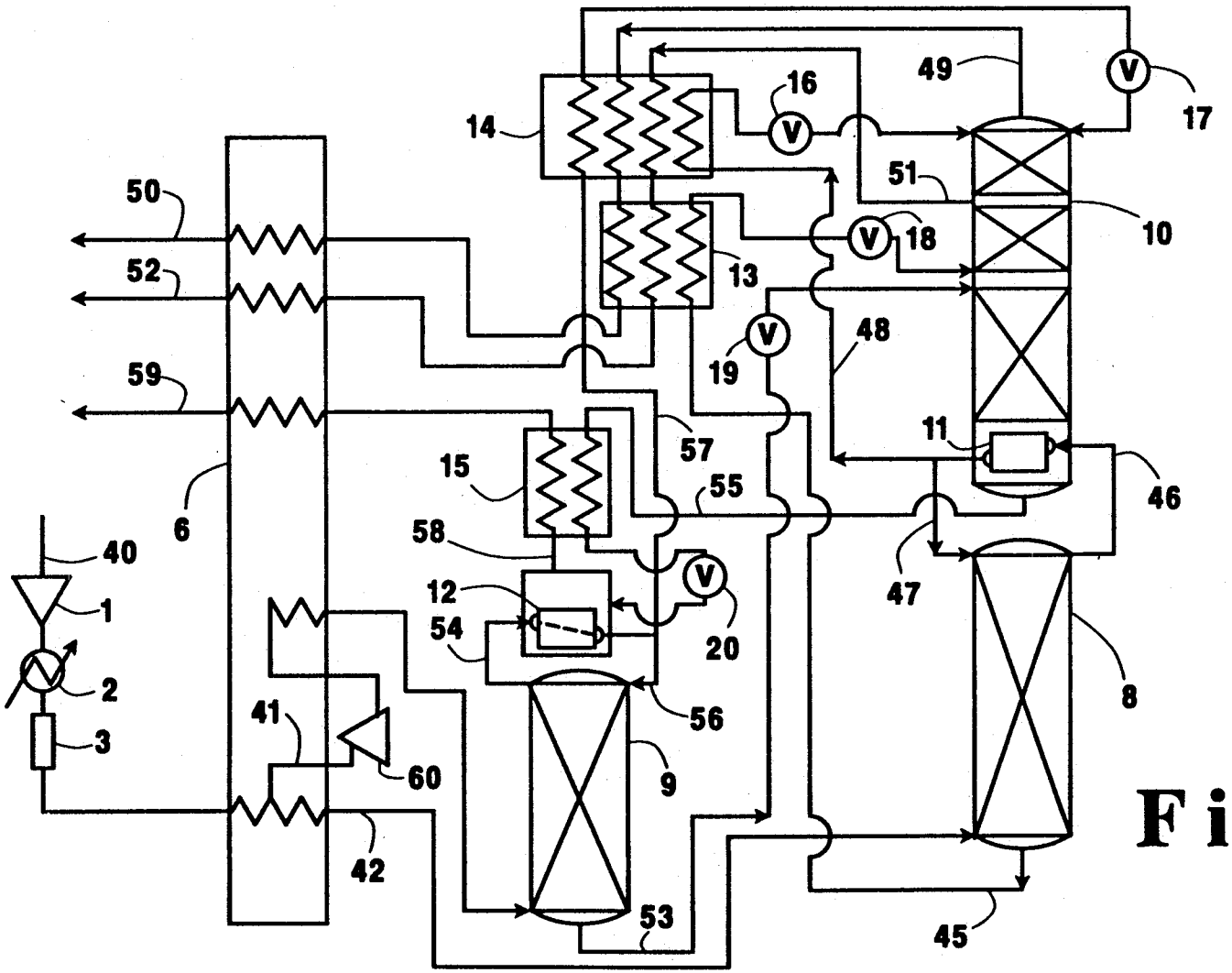
FIG. 3 is a schematic flow diagram of another preferred embodiment of the cryogenic rectification system of this invention wherein all feed air is compressed to a high pressure and the secondary feed air is branched off from the main feed air and expanded.

FIG. 3 illustrates another embodiment of the invention. The numerals in FIG. 2 correspond to those of FIGS. 1 or 2 for the common elements and these common elements will not be described again in detail. In the FIG. 3 embodiment, the entire feed air stream 40 is compressed through compressor 1 to a single pressure corresponding essentially to the pressure of higher pressure column 8. The entire cooled and cleaned feed air stream is fed into main heat exchanger 6 and is divided therein into main feed air 42 and secondary feed air stream 41. The main feed air 42 completes the traverse of heat exchanger 6 and is passed into higher pressure column 8. The secondary feed air stream 41 is expanded through expander 60 as in the FIG. 2 embodiment, further cooled through heat exchanger 6 and passed into auxiliary column 9.

Although the invention has been described in detail with reference to certain preferred embodiments, those skilled in the art will recognize that there are other embodiments of the invention within the spirit and the scope of the claims. For example, the liquids derived from the auxiliary column need not be directed into the lower pressure column. The high purity liquid nitrogen and the oxygen enriched liquid bottoms of the auxiliary column could alternatively be increased in pressure by any combination of available liquid head and/or mechanical pump so that they may be fed directly to the higher pressure column. Also, liquids derived from the high pressure column may be subcooled and/or reduced in pressure and subsequently fed to the auxiliary column. There may be instances where the double column plant may find an optimal performance pressure in which the pressure of lower pressure column 10 is in excess of the pressure of operation for auxiliary column 9. If this is the case, mechanical pumps will be required to elevate the pressure of the liquids derived from the auxiliary column so that they may be fed to column 10. In this case, valves 17 and 19 would be replaced by mechanical pumps. In addition, an argon sidearm column may readily be combined with the system of this invention in cases where argon product is desired. Furthermore, liquid oxygen and/or liquid nitrogen may be recovered from the system such as by recovering a portion of stream 55, stream 48 or stream 57.

I claim:

1. A method for the cryogenic rectification of feed air comprising:

(A) providing feed air into a double column air separation plant having a higher pressure column and a lower Pressure column and separating the feed air by cryogenic rectification in the double column plant into nitrogen vapor and oxygen liquid;

(B) providing secondary feed air into an auxiliary column operating at a pressure less than that of said higher pressure column and separating the secondary feed air by cryogenic rectification in the auxiliary column into nitrogen-enriched vapor and oxygen-enriched liquid;

(C) passing oxygen-enriched liquid from the auxiliary column into the double column air separation plant, withdrawing oxygen liquid from the double column air separation plant, and reducing the pressure of the withdrawn oxygen liquid;

(D) condensing nitrogen-enriched vapor by indirect heat exchange with reduced pressure oxygen liquid and passing at least a portion of the resulting condensed nitrogen-enriched fluid into the double column air separation plant; and (E) recovering oxygen fluid resulting from the indirect heat exchange with nitrogen-enriched vapor as product oxygen.

2. The method of claim 1 wherein the oxygen-enriched liquid from the auxiliary column is passed into the lower pressure column of the double column air separation plant.

3. The method of claim 1 wherein the said portion of the condensed nitrogen-enriched fluid is passed into the lower pressure column of the double column air separation plant.

4. The method of claim 1 further comprising recovering nitrogen vapor as product nitrogen.

5. The method of claim 1 further comprising recovering some nitrogen-enriched vapor as product nitrogen.

6. The method of claim 1 further comprising recovering some oxygen liquid as liquid oxygen product.

7. The method of claim 1 further comprising recovering some condensed nitrogen fluid as liquid nitrogen product.

8. The method of claim 1 wherein the secondary feed air is expanded prior to being provided into the auxiliary column.

9. Apparatus for the cryogenic rectification of feed air comprising:

(A) a double column air separation plant having a higher pressure column and a lower pressure column, and means for providing feed air into the double column air separation plant;

(B) an auxiliary column having a top condenser and means for providing feed air into the auxiliary column;

(C) means for passing fluid from the lower portion of the auxiliary column into the double column air separation plant, and means for passing fluid from the upper portion of the auxiliary column into the top condenser;

(D) means for passing fluid from the double column air separation plant to pressure reducing means and from the pressure reducing means into the top condenser;

(E) means for passing fluid from the top condenser into the double column air separation plant and means for recovering fluid from the top condenser.

10. The apparatus of claim 9 wherein the means for passing fluid from the lower portion of the auxiliary column into the double column air separation plant communicates with the lower pressure column.

11. The apparatus of claim 9 wherein the means for passing fluid from the top condenser into the double column air separation plant communicates with the lower pressure column.

12. The apparatus of claim 9 further comprising means for recovering fluid withdrawn from the upper portion of the lower pressure column.

13. The apparatus of claim 9 wherein the means for providing feed air into the auxiliary column comprises an expander.

14. The apparatus of claim 9 further comprising means for passing fluid from the top condenser into the auxiliary column.

* * * * *